US009238967B2

(12) United States Patent
Saunders et al.

(10) Patent No.: US 9,238,967 B2
(45) Date of Patent: Jan. 19, 2016

(54) ENVIRONMENTALLY SEALED COMBUSTION POWERED LINEAR ACTUATOR

(71) Applicant: Boston Dynamics, Inc., Waltham, MA (US)

(72) Inventors: Aaron Saunders, Arlington, MA (US); Christopher Everett Thorne, Somerville, MA (US); Alfred Anthony Rizzi, Belmont, MA (US)

(73) Assignee: Google Inc., Mountain View, CA (US)

( * ) Notice: Subject to any disclaimer, the term of this patent is extended or adjusted under 35 U.S.C. 154(b) by 735 days.

(21) Appl. No.: 13/624,006

(22) Filed: Sep. 21, 2012

(65) Prior Publication Data

US 2014/0083077 A1 Mar. 27, 2014

(51) Int. Cl.

| | |
|---|---|
| ***F02B 71/00*** | (2006.01) |
| ***F01B 11/00*** | (2006.01) |
| *F02B 75/04* | (2006.01) |
| *F02B 71/04* | (2006.01) |
| *F02B 75/02* | (2006.01) |

(52) U.S. Cl.

CPC ..... *F01B 11/008* (2013.01); *F02B 71/00* (2013.01); *F02B 71/04* (2013.01); *F02B 71/045* (2013.01); *F02B 75/04* (2013.01); *F02B 2075/025* (2013.01)

(58) Field of Classification Search

CPC .... F02B 71/00; F02B 71/04; F02B 2075/025; F02B 71/045; F02B 75/04

USPC ..... 123/46 R

See application file for complete search history.

(56) References Cited

U.S. PATENT DOCUMENTS

| | | | | |
|---|---|---|---|---|
| 2,158,180 | A | 5/1939 | Goddard | |
| 6,247,546 | B1 | 6/2001 | Spletzer et al. | |
| 6,328,002 | B1 | 12/2001 | Spletzer et al. | |
| 7,263,955 | B1 * | 9/2007 | Fischer | 123/46 R |
| 7,650,919 | B2 | 1/2010 | Rhyne et al. | |
| 7,775,305 | B1 | 8/2010 | Fischer | |
| 2007/0267116 | A1 | 11/2007 | Rhyne et al. | |
| 2008/0230285 | A1 | 9/2008 | Bewley et al. | |
| 2009/0283185 | A1 | 11/2009 | Manesh et al. | |
| 2010/0078111 | A1 | 4/2010 | Anderson et al. | |
| 2010/0200131 | A1 | 8/2010 | Iwase et al. | |
| 2012/0259460 | A1 | 10/2012 | Rizzi et al. | |

OTHER PUBLICATIONS

Salton et al. and Rizzi et al., "Urban Hopper", Apr., 2010, 9 pgs. (unnumbered).

Fischer, Gary J., "Wheeled Hopping Mobility," Unmanned/Unattended Sensors an Sensor Networks II, SPIE vol. 5986, 2005, pp. 59860H-1 to 59860H-9.

Lambrecht et al., "A Small, Insect-Inspired Robot that Runs and Jumps," Proceedings of 2005 IEEE International Conference on Robotics and Automation, Apr. 2005, pp. 1240-1245.

Nasa, "Flight Path and Orientation Control," Mar. 18, 2010, 6 pages.

Office Action for U.S. Appl. No. 13/066,276 mailed Jan. 13, 2014, 24 pages.

* cited by examiner

*Primary Examiner* — Lindsay Low

*Assistant Examiner* — Charles Brauch

(74) *Attorney, Agent, or Firm* — McDonnell Boehnen Hulbert & Berghoff LLP

(57) ABSTRACT

A combustion powered linear actuator features an actuator body having a first chamber therein and a power piston mounted in the first chamber movable between retracted and extended positions. The power piston has a combustion chamber therein. A first seal about the piston seals the piston with respect to the actuator body. A vent region in the body of increased diameter allows exhaust gases to bypass the first seal and flow into a space between the piston and the actuator body and to then vent out of the actuator body. A second seal proximate the distal end of the actuator body cooperates with another piston seal to seal the annular region when the piston is retracted. The vent region may include a vent gland in the first chamber about the piston defining a vent chamber between the actuator body and the vent gland.

49 Claims, 7 Drawing Sheets

ENVIRONMENTALLY SEALED COMBUSTION POWERED LINEAR ACTUATOR

FIELD OF THE INVENTION

The subject invention relates to actuators and, in some embodiments, robotics.

BACKGROUND OF THE INVENTION

Hopping robots are described in U.S. Pat. Nos. 7,263,955; 7,775,305; 6,247,546; and 6,328,002 as well as in pending application Ser. No. 13/066,276 filed Apr. 11, 2011, all of which are incorporated herein by this reference. A combustion powered linear actuator is used to provide hopping mobility In the designs of U.S. Pat. No. 7,263,955, the actuator piston is releasably latched to the actuator body via a magnet which is exposed to the environment can become fouled when the piston extends. In cases where the piston cannot be retracted or will not stay in the retracted position because of magnet fouling, operation of the robot via a hopping action would be hindered.

Moreover, the combustion gas exhaust ports of the designs depicted in the '995 patent are not sealed when the piston is retracted which can lead to contamination of the components of the actuator in harsh environments. Such contamination may result in a failure to function and premature wear.

SUMMARY OF THE INVENTION

The invention provides, in one particular example or embodiment, a new linear actuator sealed with respect to the environment when the piston is retracted. And yet, the seals used are configured to allow exhaust gasses to exit the actuator when the piston extends. In some aspects, the invention features a linear actuator configured with a magnetic latch protected from the environment. In another aspect, the invention improves on the linear actuator of U.S. Pat. No. 7,263,955 in other respects. The actuator can be used with hopping robots of different configurations including, but not limited to, the hopping robot depicted in U.S. Pat. No. 7,263,955 and the hopping robot depicted in U.S. application Ser. No. 13/066,276 filed Apr. 11, 2011.

Featured is a combustion powered linear actuator comprising an actuator body having a first chamber therein and a power piston mounted in the first chamber movable between retracted and extended positions. The power piston has a combustion chamber therein. A first seal is disposed about the piston and seals the piston with respect to the actuator body. A vent region in the body of increased diameter allows exhaust gases to bypass the first seal to a space between the piston and the actuator body and to vent out of the actuator body. A second seal proximate the distal end of the actuator body cooperates with a seal body to seal the vent region when the piston is retracted.

In one preferred version, vent region includes a vent gland in the first chamber about the piston defining a vent chamber between the actuator body and the vent gland. The vent gland may include upper exhaust ports venting exhaust gases from the first chamber into the vent chamber and lower exhaust ports venting the exhaust gases from the vent chamber out the distal end of the actuator body. The second seal is preferably a lip seal mounted to the vent gland.

Further included is a foot attached to the distal end of the piston. One foot has a non-circular face, e.g., a rectangular face. Then, the piston includes a keyed feature and the vent gland includes a piston orientation bearing constraining the piston from rotation. The piston keyed feature may include flat regions. The piston may also include a tapered nozzle communicating with the combustion chamber.

A latch releasably retains the piston in a retracted position. The latch typically includes a magnet. One latch further includes a first flux guide fixed to the top of the actuator body and housing the magnet. A non-ferrous magnet isolator may be disposed at least partially about the magnet. The actuator may include plating at least partially over the first flux guide and the isolator. The first flux guide may include one or more fuel ports leading into the combustion chamber and a glow plug for igniting fuel in the combustion chamber. The piston also includes a proximal flux guide mateable with the first flux guide. A seal may be disposed between the proximal flux guide and the first flux guide. A wear ring may also be disposed about the proximal flux guide.

A spring about the piston is configured to retract the piston. Preferably, the spring is isolated from the vent region. The piston may include a stop member and the vent region includes a stop surface.

One combustion powered linear actuator includes an actuator body having a first chamber therein, a power piston mounted in the first chamber movable between retracted and extended positions, the power piston having a combustion chamber therein, a vent gland disposed between the actuator body and the power piston defining an annular vent chamber between the vent gland and the actuator body, a seal portion on the distal end of the piston, and a seal mounted to the vent gland proximate the distal end of the actuator body cooperating with the seal portion sealing the annular vent chamber when the piston is retracted.

A combustion powered linear actuator in accordance with examples of the invention includes an actuator body having a first chamber therein and a power piston mounted in the first chamber moveable between retracted and extended positions. The power piston includes a combustion chamber therein. A vent region in the actuator body exhausts gases from the combustion chamber and first chamber through one or more ports. One or more seals seal the piston with respect to the actuator body and the vent region port or ports with respect to the atmosphere when the piston is in the retracted position. Preferably, the vent region includes a vent gland in the actuator body defining an annular vent chamber between the actuator body and the vent gland. The vent gland may include exhaust ports venting exhaust gases from the first chamber into the annular vent chamber and also exhaust ports venting exhaust gases from the annular vent chamber to the atmosphere.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
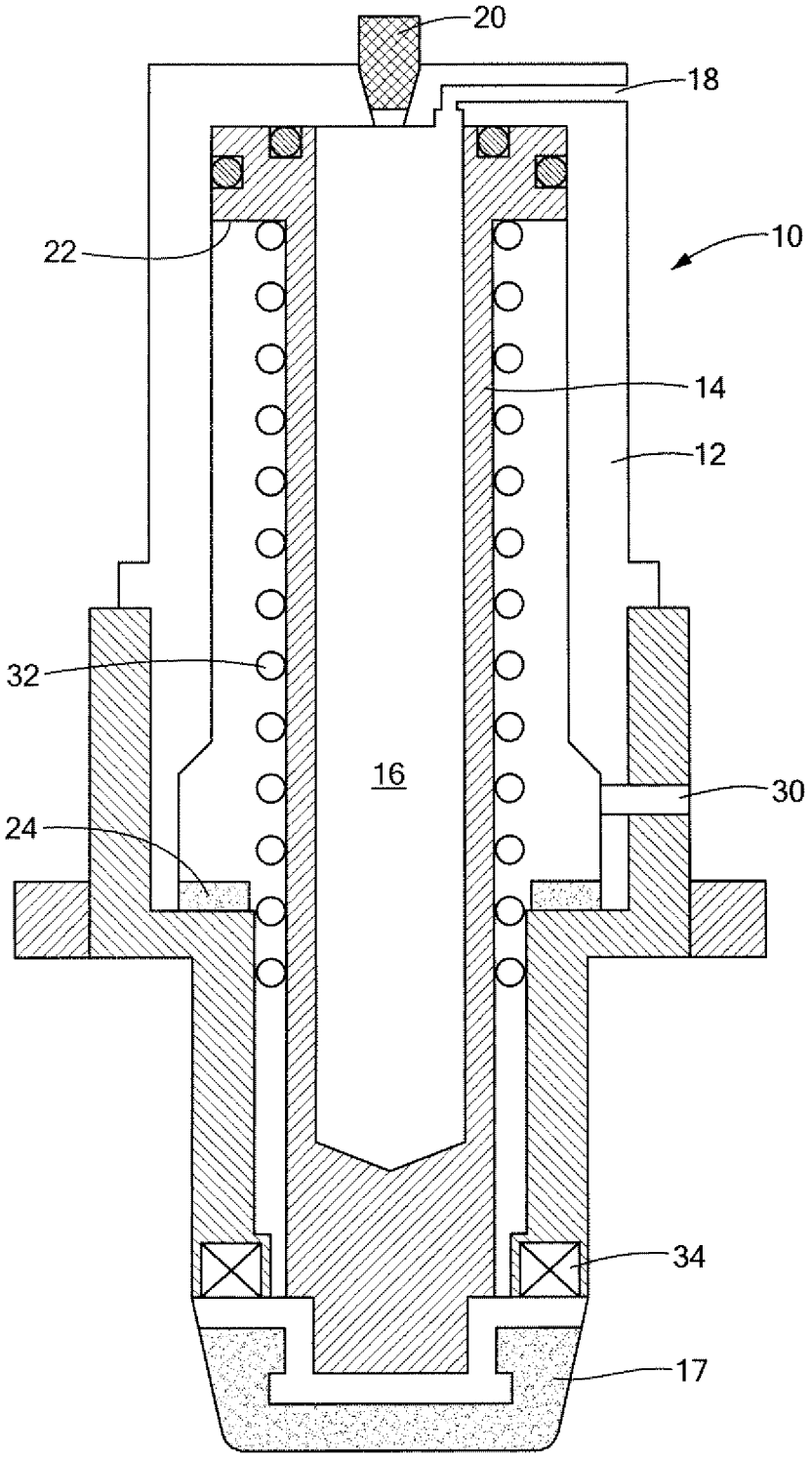
FIG. 1 (PRIOR ART)
FIG. 1 is a schematic cross sectional front view of a prior art linear actuator in accordance with U.S. Pat. No. 7,263,955.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows prior art actuator 10 with body 12 defining a cylinder for piston 14 which includes internal combustion chamber 16 and foot 17. Fuel enters combustion chamber 16 via port 18 and is ignited by glow plug 20. Piston 16 then extends until stop surface 22 reaches compliant extension stop 24. The exhaust gases then exit the combustion chamber 16 and the cylinder via port 30 and also via the bottom of the actuator in the space between the piston and the actuator body. Spring 32 retracts the piston to its retracted position and magnet 34 retains the piston in the retracted position during refueling of combustion chamber 16.

Note that water and other contaminants can enter exhaust port 30 and adversely affect the operation of the actuator in harsh environments. Also, when the piston is extended, magnet 34 can become fouled by debris. As noted in the Background section above, if the magnet becomes fouled it may be the case that the piston cannot be retracted and/or will not stay in the retracted position.

In a new design, in one example, a harsh environment combustion powered actuator is featured wherein the actuator volume is sealed with respect to the environment when the piston is retracted. The actuator of volume is open to the atmosphere only after a specified piston travel in order to allow exhaust gases to exit and thereby allow the piston to be more easily retracted and latched into the retracted position. The magnetic latch used, in one preferred embodiment, is positioned inside the sealed actuator volume to prevent accumulation of ferrous particles (commonly found in sand and dirt) on the magnetic latch which would prevent the actuator from closing and adversely affect refueling operations. In one version, a non-circular (e.g., rectangular) foot is used and means are provided for orientation control of the piston and foot combination. Wear elements are provided on the piston in order to extend the life of the actuator. Featured is a wear element retention method tolerant of high speed gas velocity during venting. A coaxial low resistance exhaust path bypasses the retraction spring and orientation control bearing. A specialized fueling chamber nozzle is included to reduce the required latching force holding requirements. A piston extension stop prevents entanglement with the retraction spring at full extension of the piston and compression of the spring. Not every embodiment, however, includes all these features.

New actuator 50, FIG. 2, includes actuator body 52 having chamber 54 therein. Power piston 56 includes combustion chamber 58 therein. Power piston 56 is mounted in chamber 54 and movable between retracted (FIG. 2) and extended (FIG. 3) positions. One or more seal rings 60 about the piston seal piston 56 with respect to body 52 except near the bottom end of the piston stroke wherein the rings encounter a vent region 62 which has an increased diameter at 64 tapering outward at 66 from lesser diameter 68.

Seal body 70 is disposed about the distal end of the piston and environmental lip seal 72 cooperates with seal body 70 to seal annular region 80 when the piston is retracted to prevent contamination of the interior of the actuator. In other embodiments, the two pistons seals (60 and 70, 72) which seal the actuator when the piston is retracted and allow exhaust gasses to exit the actuator when the piston extends, may take other forms.

Although not necessarily a limitation, FIGS. 2 and 3 show annular gland member 90 fixed with respect to actuator body 52 and which defines annular vent region 80. Gland 90 includes upper exhaust ports 92 and lower exhaust ports 94. These ports are sealed when the piston is retracted via seal 72 and rings 60. Now the space between the piston and the chamber is subdivided into region 81*a* for spring 160 and region 81*b* for the exhaust gasses.

Figure 3A:
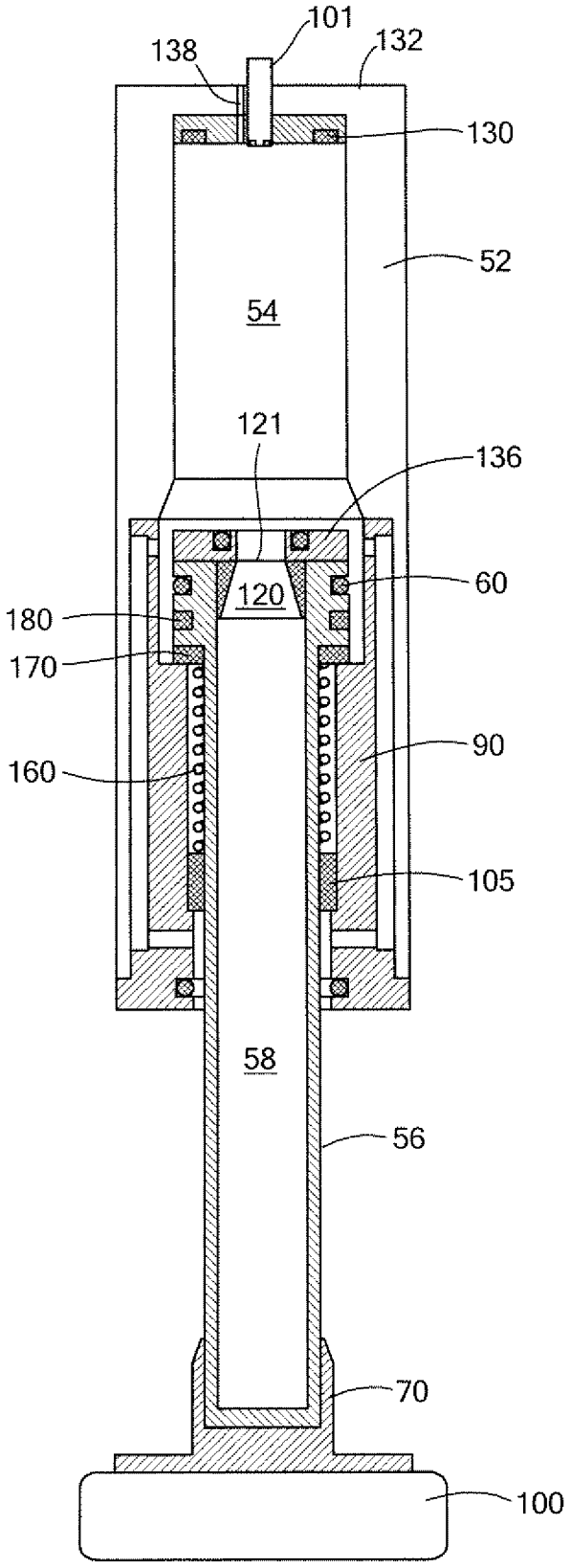
FIG. 3A is a schematic cross sectional view showing the linear actuator of FIG. 2 with the piston now extended.
Figure 3B:
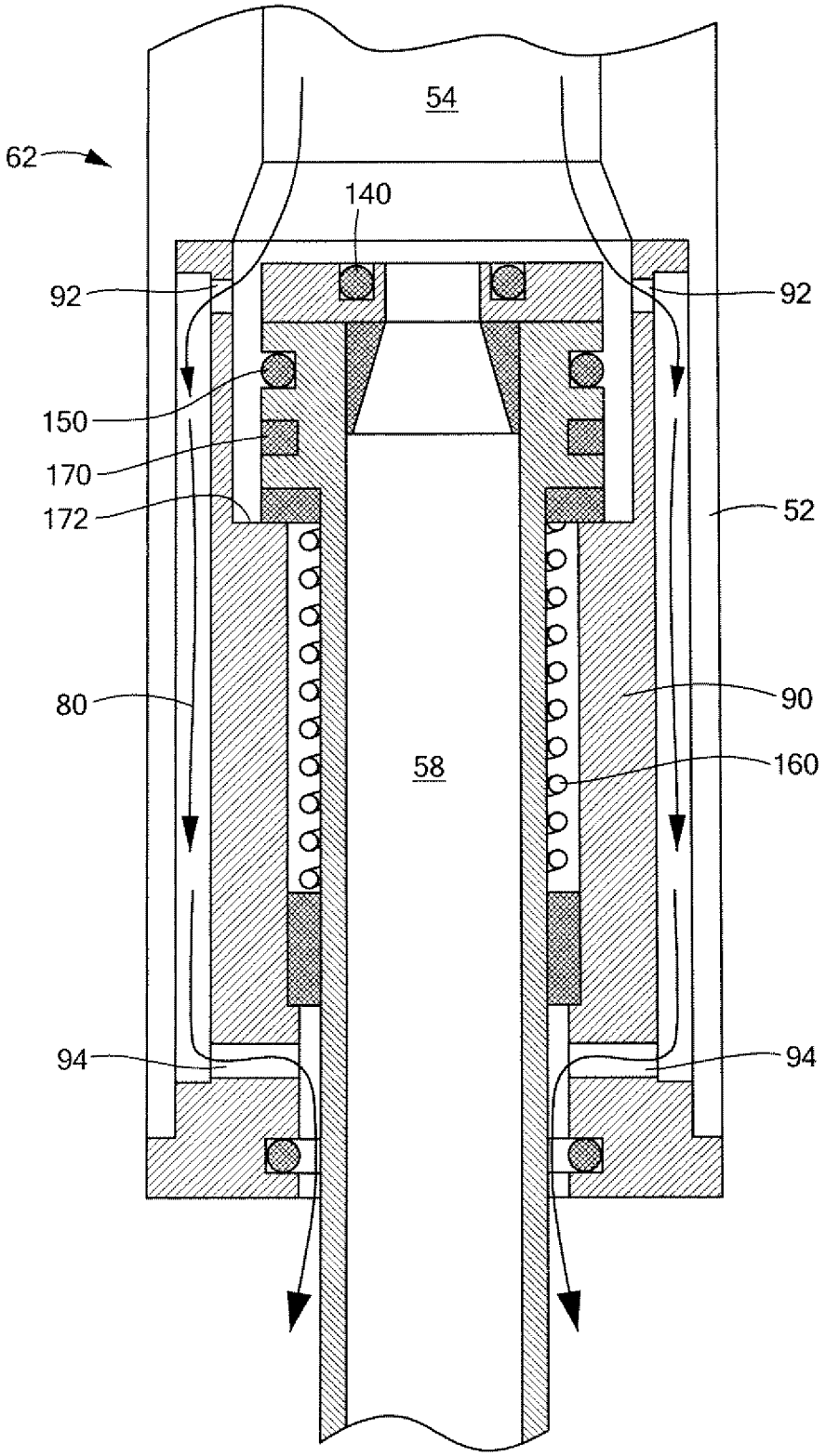
FIG. 3B is a close-up view showing a portion of the linear actuator of FIG. 3A.
Figure 3C:
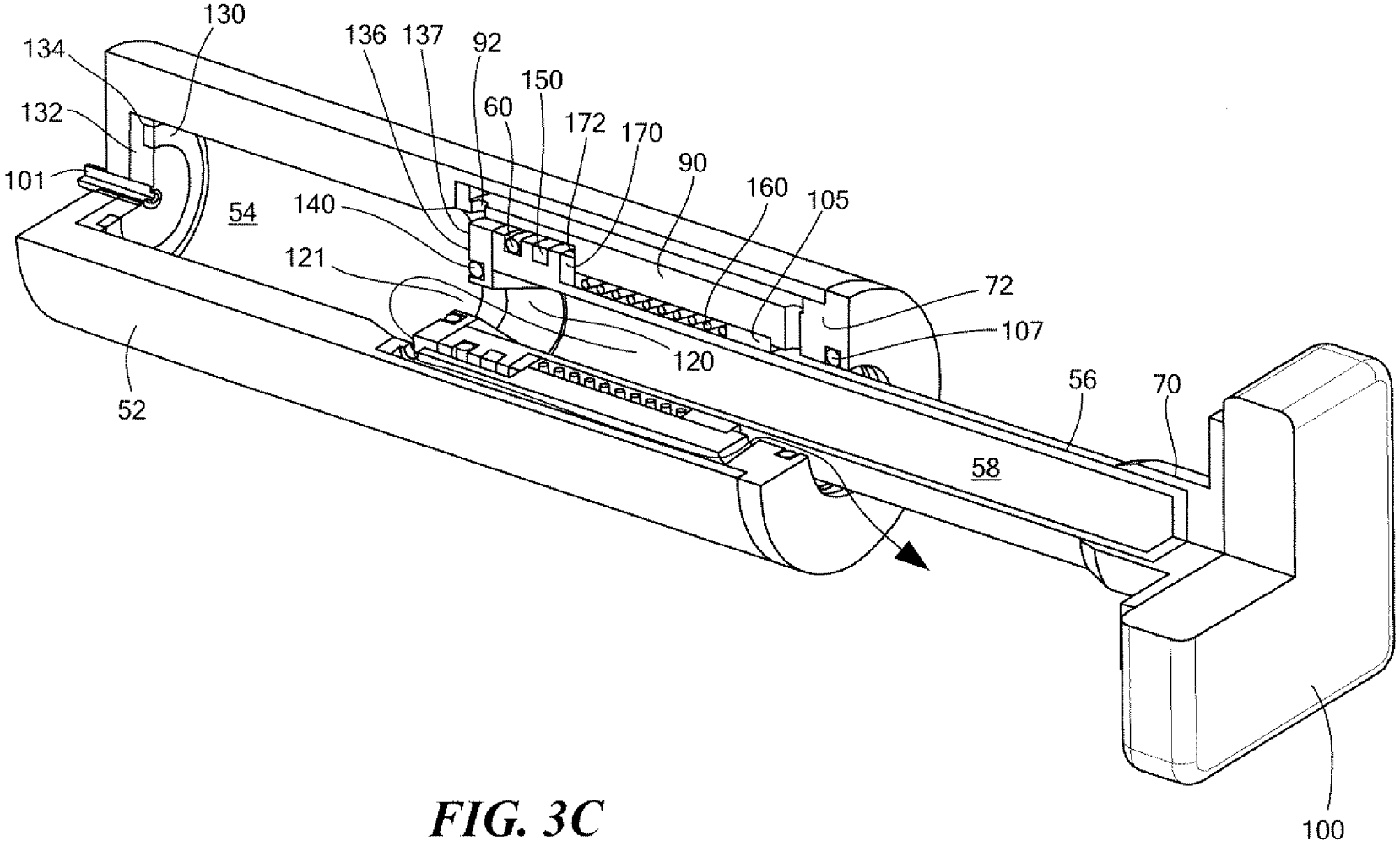
FIG. 3C is a schematic three dimensional partially cut away view of the linear actuator of FIGS. 3A and 3B.

Upon ignition of the fuel in combustion chamber 58 by a controllable source such as glow plug 101, as show in FIGS. 3A-3C, piston 56 extends and exhaust gases exit from combustion chamber 58 through nozzle 120 and piston port 121 and then out of chamber 54 via ports 92, chamber 80, ports 94, and the bottom of actuator body 52 which is no longer sealed with respect to the piston via seal 72 and seal body 70. This coaxial low resistance exhaust path design results in an actuator volume sealed with respect to the environment when the piston is in the retracted or closed state. Only after a specified piston travel upon combustion of the fuel is the actuator open to atmosphere in order to allow the exhaust gases to exit and thereby allow the piston to be retracted again. Also, spring 160 is isolated form the exhaust gasses.

Figure 4:
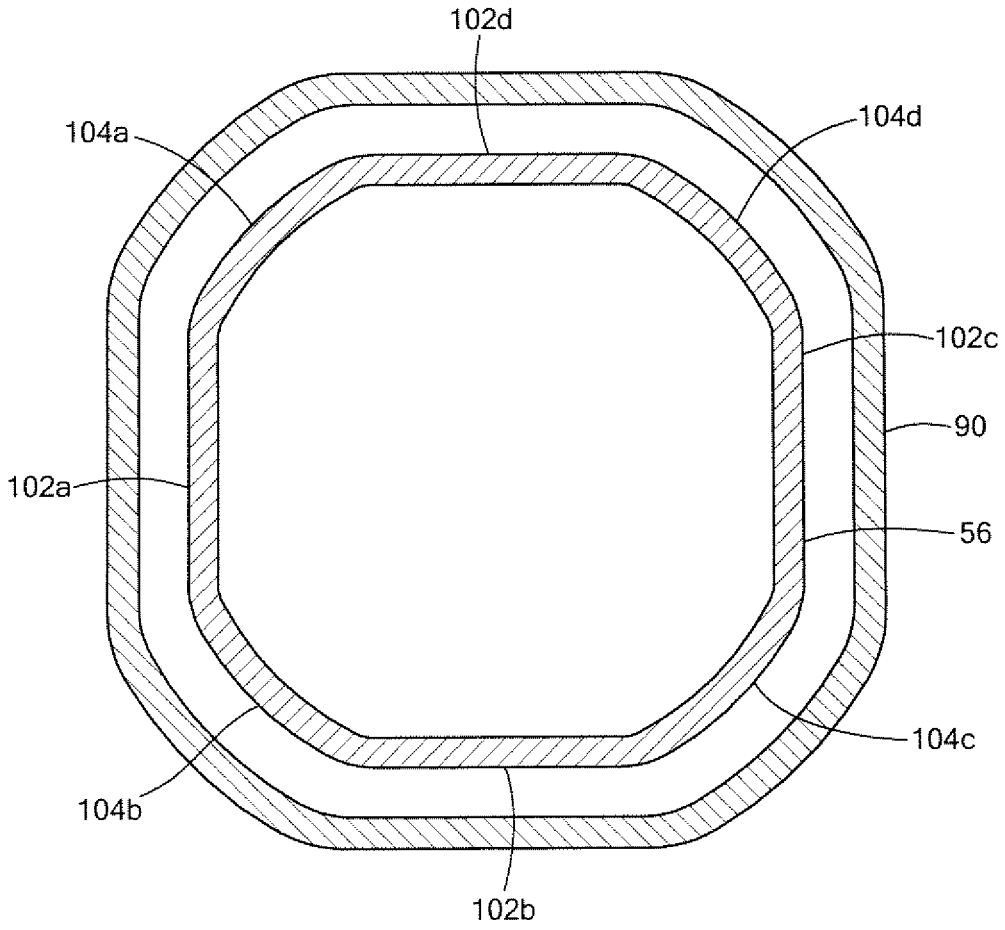
FIG. 4 is schematic cross sectional view showing the configuration of the piston and the vent gland of FIGS. 2-3 in accordance with some examples of the invention.

The figures show lip seal 72 is attached to vent gland 90 in one preferred embodiment. Piston foot 100 is also shown and typically has a non-circular (e.g., rectangular) face as shown for improved actuation of the robot in some terrain configurations. Thus, to prevent the piston and the foot from rotation during piston extension, the piston may include a keyed feature and vent glad 90 includes a piston orientation bearing of some type cooperating with the keyed feature of the piston to constrain the piston from rotation. In one version as shown in FIG. 4, the piston or at least a portion of the length thereof includes flat regions 102*a*, 102*b*, 102*c*, and 102*d* separated by round regions 104*a*, 104*b*, 104*c*, and 104*d*. Gland 90 then includes a piston orientation bearing with similar alternating round and flat regions cooperating with the profile of piston 56 in order to constrain it against rotation as it extends through gland 90. A section of gland 90 as shown in FIG. 4 is also shown at 105 in FIGS. 2 and 3 and thus functions as a piston orientation bearing and wear element and may include or be made of Teflon, or the like. Another seal includes O-ring 107 sealing lip seal 72 with respect to the interior of actuator body 52.

Figure 2A:
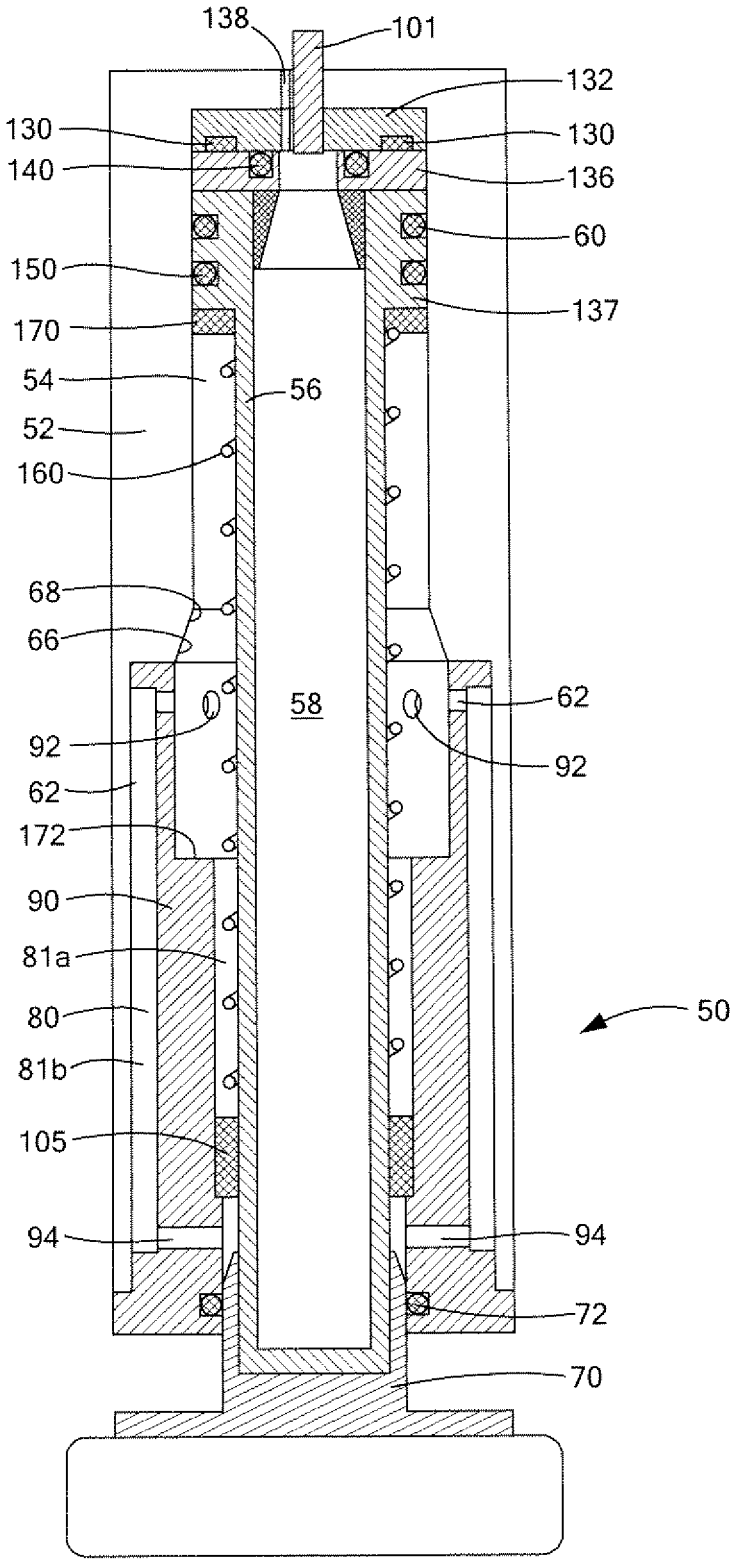
FIG. 2A is a schematic front cross sectional view of an example of a linear actuator in accordance with the invention with the piston retracted.
Figure 2B:
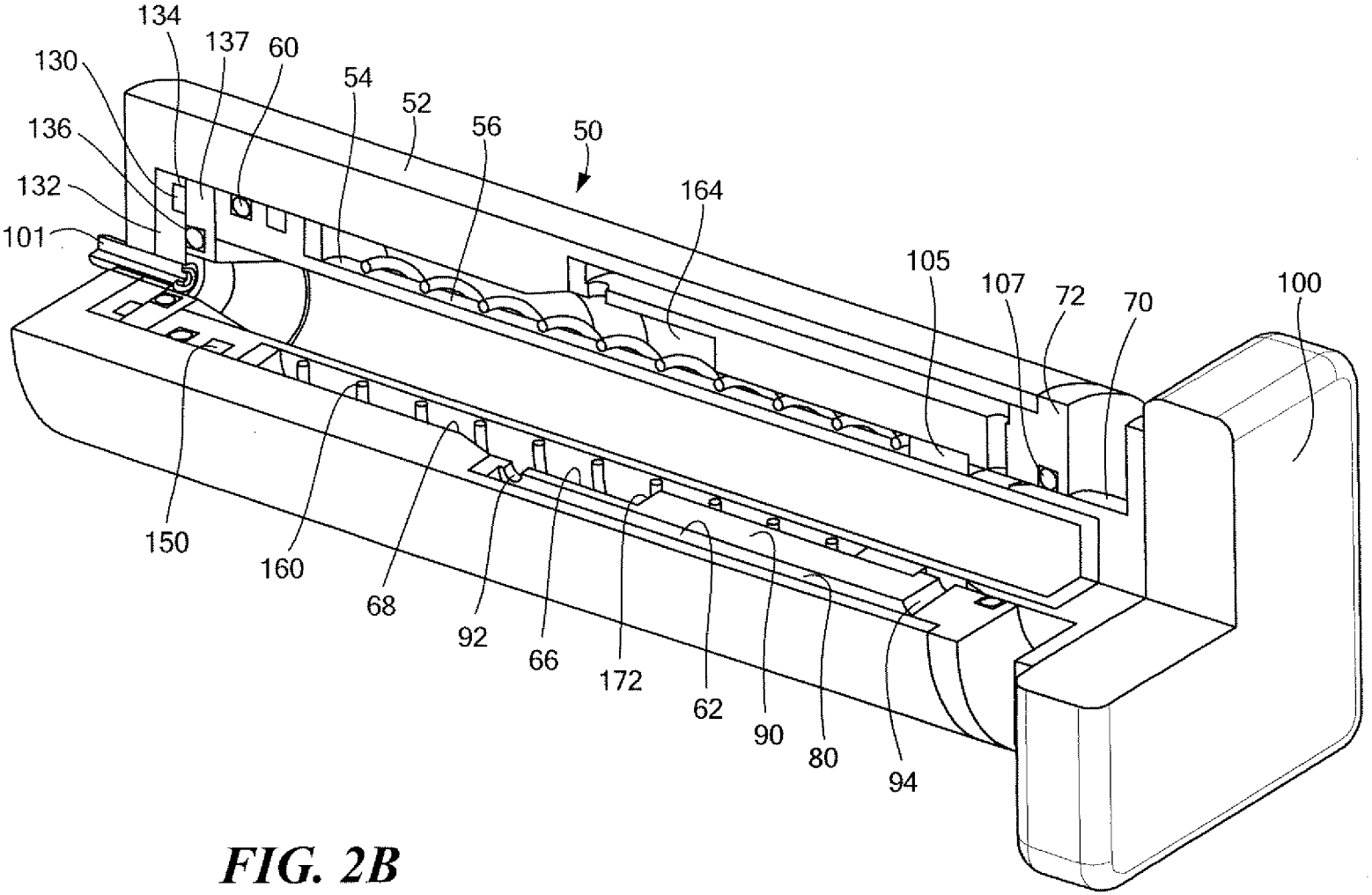
FIG. 2B is a schematic three dimensional partially cut away view showing the linear actuator of FIG. 2A.

Another feature of the invention, in some embodiments, includes tapered nozzle 120, FIGS. 1-3 communicating with piston combustion chamber 158. Tapered nozzle 120 allows for a smaller magnet to be included in the latch which releasably retains the piston in its retracted position. The seal area between the top port and the combustion chamber is reduced and thus the latching force required is reduced. FIGS. 2-3 show magnet 130 set in flux guide 132 fixed to the top of the actuator body 52. FIGS. 2B and 3C, in particular, show how, in one preferred version, non-ferrous magnetic isolator 134 (made of aluminum, for example) is disposed partially about ring-shaped magnet 130. Chrome or nickel plating is also disposed over the surfaces of flux guide 132 and isolator 134. Typically, the magnet and isolator are press fit into flux guide 132. The magnetic latch is attracted to the top surface 136 of piston 56 flux guide 137 and retains the piston in a retracted position as shown in FIGS. 2A and 2B during refueling operations where the pressure inside combustion chamber 58 can reach 200 psi. Flux guide 132 may also include one or more fuel ports such as fuel port 138 leading into combustion chamber 58 via nozzle 120. O-ring seal 140 is typically provided to seal housing flux guide 132 with respect to piston flux guide 137 during fueling operations.

Further included may be wear ring 150 made of or including Teflon and configured about piston flux guide 137 to mate with the interior wall surface of housing 52. In the design shown, wear ring 150 is disposed about piston flux guide 137. Spring 160 is disposed about the piston and is configured to retract the piston after extension and exhaust gas venting. In this preferred design, spring 160 is isolated from vent region 62 by gland 90 and thus a longer life is expected of spring 160. Also, stop member 170 is preferably a component of piston 56 and mates with stop surface 172 in vent region 62 defined by a shelf formed within gland 90.

Thus, a harsh environment combustion powered actuator is featured wherein the actuator volume is sealed with respect to the environment when the piston is retracted. The magnetic latch used, in one preferred embodiment, is inside the sealed actuator volume to prevent accumulation of ferrous particles (commonly found in sand) on the magnetic latch which would prevent the actuator from closing and adversely affect refueling operations. In one version, a non-circular (e.g., rectangular) foot is used and means are provided for orientation control of the piston and foot combination. Wear elements are provided on the piston in order to extend the life of the actuator. A coaxial low resistance exhaust path bypasses the retraction spring and the orientation control bearing. A specialized fueling chamber nozzle is included to reduce the required latching force holding requirements. A piston extension stop prevents entanglement with the retraction spring at full extension of the piston and compression of the spring.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A combustion powered linear actuator comprising:

an actuator body having a first end, a second end, and a first chamber within the actuator body;

a power piston mounted in the first chamber movable between retracted and extended positions, the power piston having a first end, a second end, and a combustion chamber within the power piston;

a first seal about the first end of the power piston sealing the power piston with respect to the actuator body;

a vent region in the actuator body of increased diameter configured to allow exhaust gases to bypass the first seal to a space between the power piston and the actuator body and to vent out of the actuator body;

a seal body at the second end of the power piston; and a second seal proximate the second end of the actuator body configured to cooperate with the seal body to seal the vent region when the power piston is retracted.

2. The actuator of claim 1 in which the vent region includes a vent gland in the first chamber about the power piston defining a vent chamber between the actuator body and the vent gland.

3. The actuator of claim 2 in which the vent gland includes one or more upper exhaust ports configured to vent exhaust gases from the first chamber into the vent chamber and one or more lower exhaust ports configured to vent the exhaust gases from the vent chamber out the second end of the actuator body.

4. The actuator of claim 2 in which the second seal is a lip seal mounted to the vent gland.

5. The actuator of claim 1 further including a foot attached to the second end of the power piston.

6. The actuator of claim 5 in which the foot has a non-circular face.

7. The actuator of claim 6 in which the foot has a rectangular face.

8. The actuator of claim 2 in which the power piston includes a keyed feature and the vent gland includes a power piston orientation bearing configured to constrain the power piston from rotation.

9. The actuator of claim 8 in which the power piston keyed feature includes flat regions.

10. The actuator of claim 1 in which the power piston includes a tapered nozzle configured to communicate with the combustion chamber.

11. The actuator of claim 1 further including a latch configured to releasably retain the power piston in a retracted position.

12. The actuator of claim 11 in which the latch includes a magnet.

13. The actuator of claim 12 in which the latch further includes a first flux guide fixed to the first end of the actuator body and housing the magnet.

14. The actuator of claim 13 further including a non-ferrous magnet isolator at least partially about the magnet.

15. The actuator of claim 14 further including plating at least partially over the first flux guide and the isolator.

16. The actuator of claim 13 in which the first flux guide includes one or more fuel ports leading into the combustion chamber.

17. The actuator of claim 13 in which the first flux guide includes a controllable ignition source for igniting fuel in the combustion chamber.

18. The actuator of claim 13 in which the first end of the power piston includes a second flux guide mateable with the first flux guide.

19. The actuator of claim 18 further including a seal between the second flux guide and the first flux guide.

20. The actuator of claim 19 further including a wear ring about the second flux guide.

21. The actuator of claim 1 further including a spring about the power piston configured to retract the power piston.

22. The actuator of claim 21 in which the spring is isolated from the vent region.

23. The actuator of claim 1 in which the power piston includes a stop member and the vent region includes a stop surface.

24. The actuator of claim 4 further including a third seal between the lip seal and the actuator body.

25. A combustion powered linear actuator comprising:

an actuator body having a first chamber therein;

a power piston mounted in the first chamber movable between retracted and extended positions, the power piston having a combustion chamber therein;

a vent gland disposed between the actuator body and the power piston defining a vent chamber between the vent gland and the actuator body;

a seal portion on a distal end of the power piston; and a seal mounted to the vent gland proximate to a distal end of the actuator body configured to cooperate with the seal portion on the distal end of the power piston in sealing the vent chamber when the power piston is retracted.

26. The linear actuator of claim 25 further including a power piston seal about the power piston configured to seal the power piston with respect to the actuator body.

27. The linear actuator of claim 26 in which the vent gland includes a region of increased diameter configured to allow exhaust gases to bypass the power piston seal in the vent chamber.

28. The actuator of claim 25 in which the vent gland includes one or more exhaust ports configured to vent exhaust gases from the first chamber into the vent chamber and one or more exhaust ports configured to vent exhaust gases from the vent chamber out the distal end of the actuator body bypassing the seal mounted to the vent gland.

29. The actuator of claim 25 in which the vent gland includes a power piston orientation bearing configured to constrain the power piston from rotation.

30. The actuator of claim 25 in which the power piston includes a tapered nozzle configured to communicate with the combustion chamber.

31. The actuator of claim 25 further including a power piston latch with a first flux guide on the actuator body housing a magnet.

32. The actuator of claim 31 in which the latch further includes a flux guide on the power piston.

33. The actuator of claim 25 further including a spring about the power piston configured to retract the power piston.

34. The actuator of claim 25 in which the power piston includes a stop member and the vent gland defines a stop surface.

35. A combustion powered linear actuator comprising:

an actuator body having a first chamber therein;

a power piston mounted in the first chamber moveable between retracted and extended positions, the power piston including a combustion chamber therein;

a vent region in the actuator body configured to exhaust gases from the first chamber to an environment outside the actuator body through one or more ports;

a first group of one or more seals configured to seal the combustion chamber of the power piston with respect to the first chamber of the actuator body when the power piston is in the retracted position; and a second group of one or more seals configured to seal the one or more ports in the vent region with respect to the environments when the power piston is in the retracted position, the second group of one or more seals configured to exhaust gases to the environment when the power piston extends.

36. The actuator of claim 35 in which the first group of one or more seals includes at least one proximal power piston ring and the second group of one or more seals includes at least a distal seal about the power piston.

37. The actuator of claim 35 in which the vent region includes a vent gland in the actuator body defining a vent chamber between the actuator body and the vent gland.

38. The actuator of claim 37 in which the vent gland includes one or more exhaust ports configured to vent exhaust gases from the first chamber into the vent chamber and one or more exhaust ports configured to vent exhaust gases from the vent chamber to the environment.

39. The actuator of claim 35 further including a power piston orientation bearing configured to constrain the power piston from rotation.

40. The actuator of claim 35 in which the power piston includes a nozzle configured to communicate with the combustion chamber.

41. The actuator of claim 35 further including a latch configured to releasably retain the power piston in the retracted position.

42. The actuator of claim 41 in which the latch includes a flux guide on the actuator body housing a magnet therein.

43. The actuator of claim 35 further including a spring about the power piston, wherein the spring is isolated from the vent region.

44. The actuator of claim 35 in which the power piston includes a stop member and the vent region includes a stop surface.

45. A combustion powered linear actuator comprising:

an actuator body having a first chamber therein;

a power piston mounted in the first chamber and moveable between retracted and extended positions, the power piston including a proximal port, a combustion chamber, and a nozzle tapering outwardly from the proximal port to the combustion chamber configured to reduce sealing area and latching force;

a spring configured to bias the power piston into the retracted position; and a latch configured to releasably retain the power piston in the retracted position.

46. The actuator of claim 45 in which the latch is a magnetic latch with a proximal flux guide at a top of the actuator body.

47. A combustion powered linear actuator comprising:

an actuator body having a first chamber therein;

a power piston mounted in the first chamber and moveable between retracted and extended positions, the power piston having a combustion chamber therein;

a spring configured to bias the power piston into the retracted position; and a magnetic latch in the first chamber configured to releasably retain the power piston in the retracted position.

48. The actuator of claim 47 in which the magnetic latch includes a proximal flux guide at a top of the actuator body.

49. The actuator of claim 47 in which the power piston includes a top port and a tapered nozzle between the top port and the combustion chamber.

* * * * *